United States Patent [19]

Chesnut

[11] Patent Number: 4,833,894

[45] Date of Patent: May 30, 1989

[54] ICE MAKER WITH OVERTEMPERATURE PROTECTION

[75] Inventor: Paul B. Chesnut, Owensboro, Ky.

[73] Assignee: Whirlpool Corporation, Benton Harbor, Mich.

[21] Appl. No.: 188,835

[22] Filed: May 2, 1988

[51] Int. Cl.[4] ..... F25C 5/08

[52] U.S. Cl. ..... 62/135; 62/351; 219/331; 219/517

[58] Field of Search ..... 62/73, 135, 351; 219/517, 331

[56] References Cited

U.S. PATENT DOCUMENTS

| | | | |
|---|---|---|---|
| 2,717,499 | 9/1955 | Ashby et al. | 62/351 X |
| 2,717,500 | 9/1955 | Ploeger | 62/351 X |
| 3,163,017 | 12/1964 | Baker et al. | 62/351 X |
| 3,163,018 | 12/1964 | Shaw | 62/351 X |
| 3,306,072 | 2/1967 | Dahlgren et al. | 62/351 |
| 4,068,116 | 1/1978 | McKinstry | 219/517 X |
| 4,741,169 | 5/1988 | Linstromberg | 62/135 |

*Primary Examiner*—William E. Tapolcai
*Attorney, Agent, or Firm*—Mason, Kolehmainen, Rathburn & Wyss

[57] ABSTRACT

An automatic ice maker for household refrigerator/-freezers includes a mold in which water is frozen to form ice cubes which are then ejected from the mold into an ice bin. An electric heater is provided to heat the mold after the water is frozen to release the cubes for ejection. Electrical power is provided through power leads to energize the heater when the ice is frozen; and the power is subsequently interrupted after the mold heats up to a predetermined level to release the ice cubes for ejection. A heat responsive fuse is positioned as a safety protection in-line in one of the power leads to interrupt electrical power to the heater upon the occurrence of an overtemperature condition to prevent damage to the ice maker and to the refrigerator/freezer.

10 Claims, 2 Drawing Sheets

ICE MAKER WITH OVERTEMPERATURE PROTECTION

BACKGROUND OF THE INVENTION

1. Field of the Invention

The present invention generally relates to ice makers and more particularly, to a new and improved automatic ice maker for domestic refrigerator/freezers.

2. Description of the Prior Art

Automatic ice makers for use in the freezing compartment of domestic refrigerator/freezers are old and well known; and U.S. Pat. No. 3,276,225 discloses such an ice cube maker which is operated and controlled by electrical power.

Copending and commonly assigned U.S. patent application Ser. No. 081,871, filed Aug. 3, 1987, incorporated herein by reference, discloses an improved version of a modular automatic ice maker known as a single revolution ice maker.

Typically, such ice makers are provided with an electrical resistance heater for heating an ice cube mold which is initially filled with water and then cooled until solid pieces of ice are formed. A thermostat is provided in heat transfer association with the mold to sense the frozen condition of the ice, whereupon the heater is energized for a time period to warm the mold and free the ice pieces so that a mechanical ejector can move into the mold and eject the ice pieces into an awaiting ice bin.

The improved ice maker disclosed in the aforementioned copending U.S. patent application employs a thermostat in heat transfer association with the mold, the thermostat being effective to deenergize the heater while at least a portion of the ice pieces are still within the mold at the beginning of the ejection process and this considerably speeds up an operating cycle of the automatic ice making apparatus. The thermostat has a cut-in or turn-on temperature of approximately 15° F. for energizing the heater after the ice is frozen and a reset or cut-off temperature of approximately 32° F. Thus, when the water in the mold becomes completely frozen forming solid ice pieces and the temperature drops to approximately 15° F., the thermostat closes a switch to supply electrical power to the mold heater and energize the heater. When the temperature reaches approximately 32° F., the thermostat shuts off or resets and the electric heater is deenergized. The mold temperature, however, continues to rise to a value somewhat above the freezing level after the heater is deenergized to free up the ice pieces in the mold so that they may be removed from the mold by rotating ejector blades. In normal operation, the temperature of the mold will not exceed 40° F. and will begin to drop a short time after going above the freezing level. In the event that the thermostat fails to deenergize the heater, however, excessive temperatures could be reached causing damage not only to the ice maker but also, more importantly, to an adjacent portion of a freezer cabinet.

BRIEF SUMMARY OF THE PRESENT INVENTION

An object of the present invention is to provide a new and improved ice maker and, more particularly, to provide a new and improved automatic ice maker of the type including a mold and an electric heater for heating the mold to free the ice for ejection from the mold.

Moreover, it is another object of the invention to provide a new and improved electrically powered and controlled automatic ice maker having a thermally responsive device for interrupting electrical power to the ice maker should an overtemperature condition occur.

Still another object of the present invention is to provide a new and improved refrigerator/freezer having an electrically powered ice maker in a freezing compartment thereof including mans for protecting the ice maker and the freezing compartment from damage due to the occurrence of an overtemperature condition.

Yet another object of th present invention is to provide a new and improved ice maker having an electrically heated mold and a thermally actuated fuse which is responsive to thermal conditions and effective to shut off or interrupt electrical power to the ice maker whenever a predetermined over temperature condition is reached.

A new and improved automatic ice maker in accordance with the principles of the present invention includes a mold in which water is frozen to form one or more pieces of ice. An electric heater is provided for heating the mold to free the ice for ejection from the mold into an ice bin. Electrical power for operating the ice maker is supplied through an electrical harness including electrical power leads connected with the heater. A thermally activated fuse is positioned in a heat conducting relationship to the mold to shut off the electrical power to the heater in response to the occurrence of a sensed over temperature condition thereby preventing damage to the ice maker and to the adjacent portion of the freezer compartment in which the ice maker is contained.

These and other objects, advantages and novel features of the present invention, as well as details of an illustrative embodiment thereof, will be more fully understood from the following description and the drawing.

DESCRIPTION OF THE PREFERRED EMBODIMENTS OF THE INVENTION

Figure 1:
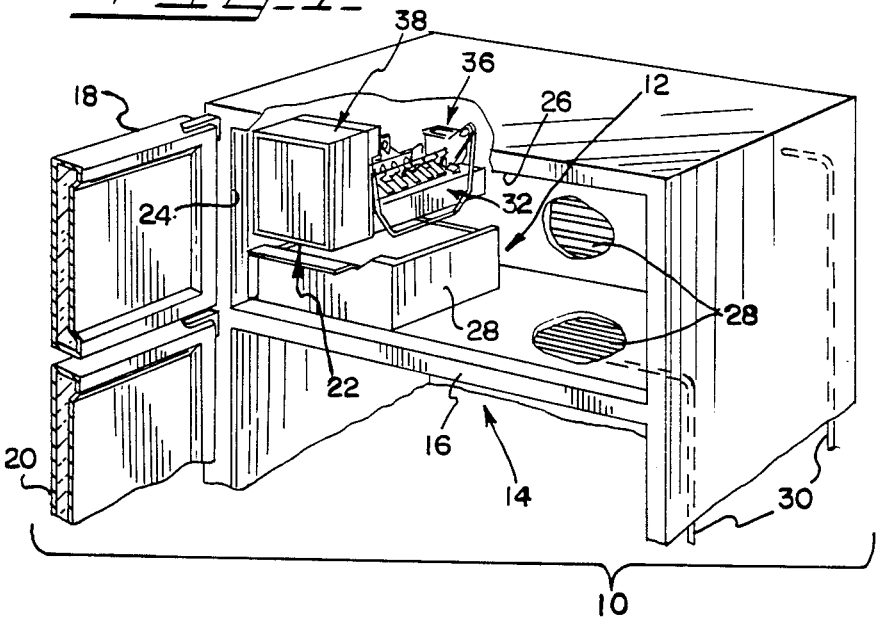
FIG. 1 depicts a refrigerator/freezer employing an automatic ice maker constructed in accordance with the principles of the present invention.

A refrigerator/freezer 10 as shown in FIG. 1 includes an upper freezing compartment 12 and a lower refrigeration compartment 14. The compartments 12 and 14 are formed with thermally insulated walls and are divided by a horizontal wall 16 forming a bottom wall of the freezing compartment 12 and a top wall of the refrigeration compartment 14. A hinged, insulated, access door 18 is provided for the upper freezing compartment 12 and a similar, but larger, insulated access door 20 is provided for the lower refrigeration compartment 14.

In accordance with the present invention, a new and improved automatic modular ice maker 22 is mounted in the freezing compartment 12, adjacent a side wall 24 and a top wall 26. In a specific embodiment, the side wall 24 is made of plastic and is susceptible to damage upon being exposed to excess heat, for example, from the adjacent ice maker 22. An ice collection bin or receptacle 28 is supported on the divider wall 16 beneath the ice maker 22 to receive pieces of ice or ice cubes that are formed in the ice maker 22. The freezing compartment 12 is cooled by evaporation coils 28 through which a refrigerant fluid flows. The refrigerant fluid supplied to the coils maintains the average temperature within the freezing compartment 12 in a desired freezing temperature range well below 32° F.

Figure 2:
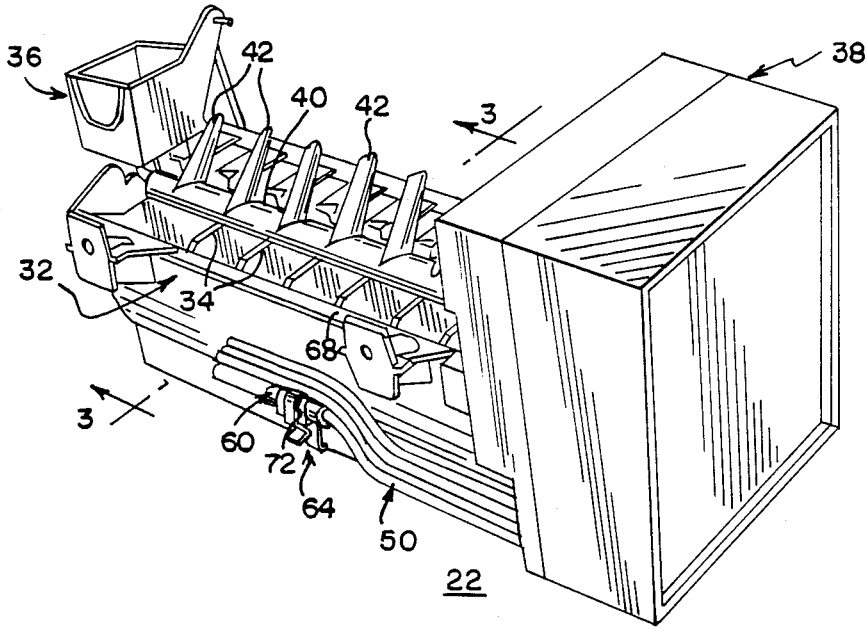
FIG. 2 is an enlarged, perspective, elevational view of the ice maker of FIG. 1.
Figure 3:
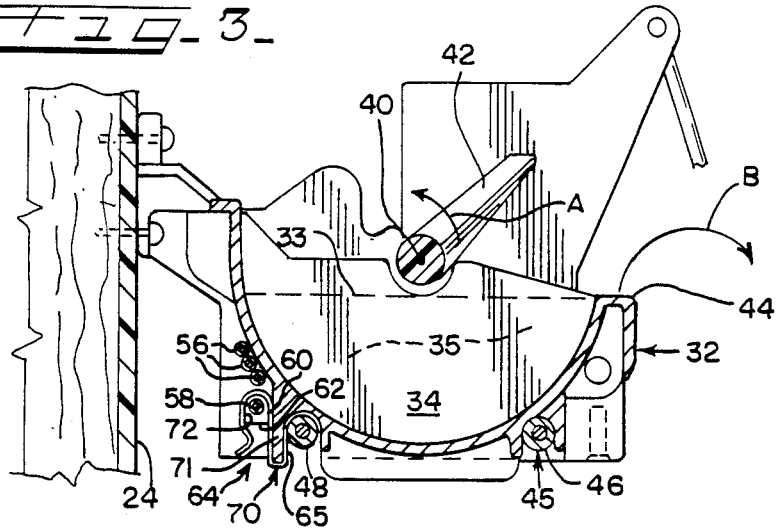
FIG. 3 is a transverse, cross-sectional view of the ice maker taken substantially along lines 3—3 of FIG. 2.

In accordance with the present invention, the automatic ice maker 22 includes an elongated mold or tray 32, preferably formed of aluminum, and having a generally semi-cylindrical shape for holding a quantity of water that is frozen into a plurality of individual ice cubes separated from one another during the freezing process by spaced apart, parallel, transversely extending, integral divider walls 34 (FIGS. 2 and 3). Water is introduced to the mold 32 through an automatic solenoid controlled water filling assembly 36 at one end of the ice maker 22 and of the mold 32, the water being supplied to the filling assembly 36 from a source outside of the refrigerator 10.

At the forward or other end of the ice maker 22, a controller box 38 is provided, the controller 38 having a generally rectangular shape or configuration with an outer casing preferably made of molded plastic material and designed to enclose and house an operating mechanism and electrical circuit components of the ice maker. These components are disclosed in detail in the aforementioned copending and commonly assigned U.S. patent application Ser. No. 081,871, incorporated herein by reference. The circuit components include a motor for rotating an elongated ejector shaft 40 extending between the ends of the mold 32 at a level just above the level 33 (FIG. 3) of the water/ice cubes 35. A plurality of longitudinally spaced apart ejector fingers 42, extending radially outwardly from the ejector shaft 40, move through individual ice cube containing compartments of the mold 32 in a counter-clockwise direction (arrow A—FIG. 3) to eject the frozen cubes 35 from the mold 32, causing them to fall into the bin 28.

In order to free the frozen ice cubes 35 from the surfaces of the mold 32 so that the cubes may be ejected therefrom, the mold 32 is provided with a U-shaped electrical resistive heating element or heater 45 including a pair of spaced apart elongate legs 46 and 48 disposed in elongate grooves provided on opposite sides of the center line of the tray on the underside thereof. The electrical heater 45 is energized for a time period commencing when the ice cubes are fully frozen, for example, at a sensed temperature of approximately 15° F., as sensed by a conventional thermostat. When the heater 45 is energized, electrical power is supplied to the heater 45 from circuitry in the controller box 38. As the heating of the mold 32 proceeds; the temperature of the mold rises to a level, for example, approximately 32° F., at which point the control switch of the thermostat interrupts electrical power to the heater 45 to deenergize the heater 45. The inside surface temperature of the mold 32 continues to rise slightly above the freezing level after the heater 45 is deenergized so that the mold surfaces in contact with the frozen ice cubes 35 cause the adjacent surface of the ice cubes to melt so that the ice cubes can be easily ejected from the tray by the ejector fingers 42.

Figure 4:
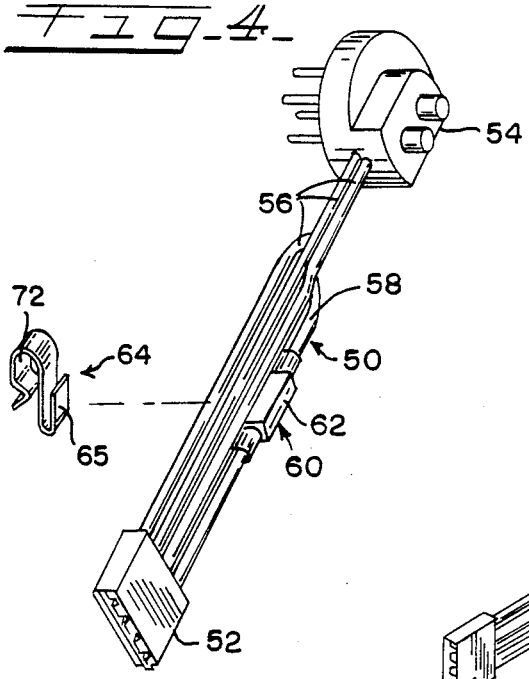
FIG. 4 is an enlarged, perspective view of a wiring harness and clip of the ice maker including a thermally responsive fuse provided for overtemperature protection.

Referring to FIGS. 2, 3 and 4, electrical power for operating the ice maker 22 including the electric resistance heater 45 is supplied to the controller box 38 through a short wiring harness 50 having a connector 52 at a forward end for interconnecting with a mating connector in the controller box 38. At the opposite or rear end, the harness 50 includes a connector 54 for interconnecting with a mating connector provided on the side wall 24 of the freezer compartment 12 and supplied with electrical power through the refrigerator/freezer 10.

The electrical harness 50 includes a plurality of separate, insulated wires or leads 56 including a power lead 58 for supplying electrical power to the heater 45. In the event that the thermostatic control switch malfunctions and fails to deenergize the heater 45 when the temperature reaches a level of approximately 32° F. at the beginning of an ice cube harvesting cycle, the heater 45 will continue to heat the mold 32. Such a condition, if unchecked, can result in damage to the components of the ice maker 22 as well as to the adjacent wall 24 and, possibly, to other portions of the freezing compartment 12. In order to prevent such an occurrence, the power lead 58 of the harness 50 is provided with an in-line thermally actuated fuse 60 that opens in response to a prolonged overtemperature condition to interrupt the flow of electric current through the power lead 58. The fuse 60 includes an elongated, flat, generally rectangular-shaped thermally sensitive contact surface 62 that is placed in contact with an outside surface of the mold 32 at a level intermediately between the level of the electric heater 45 and the lower side edge 44 of the mold body 32. Referring to FIGS. 2 and 3, the fuse 60 is positioned to lie approximately midway along the length of the mold 32 between the front and rear ends thereof.

The fuse 60 is maintained in the proper orientation and position with the thermally sensitive surface 62 held directly against the mold 32 by a resilient spring clip 64 formed from a thin strip of heat conductive material such as stainless steel. The resilient clip 64 includes a hooked end portion 65 (FIGS. 3 and 4) at the lower end thereof. The end portion 65 is adapted to snap into a slot or locating recess 70 disposed along a rib 71 formed at the underside of the mold 32. A resilient fuse receptacle or pocket 72 is provided in order to releaseably retain the body of the fuse 60 so that the thermally sensitive contact surface 62 is disposed in the direction of and in a thermally conducting relationship with respect to the mold 32. After a fuse 60 is snapped into the resilient pocket 72 of the spring clip 64, the clip 64 is snapped into place on the body of the mold 32 (FIGS. 2 and 3). In this manner, the fuse 60 is held firmly in thermally conducting contact with the adjacent surface of the mold 32. Due to the position of the fuse 60 with respect to the mold 32 and also because the spring clip 64 is made of a heat conductive material, the fuse 60 senses the approximate average temperature of the mold 32 and is responsive thereto to prevent damage to the components of the ice maker 22 and of the refrigerator/freezer 10.

A suitable thermally activated fuse 60 for use with the ice maker 22 is one manufactured by the MICRO-DEVICES division of Thermodisk, a division of Emerson Electric Co., as part No. 4178. That fuse is capable of handling up to fifteen amps at 115 volts and has a trip temperature setting of 170° F. which is well above the ideal maximum mold temperature of about 40° F. but well below the melting point of most plastic materials and wall liners used in refrigerator/freezers. The trip value of 170° F. is also well above the maximum temperature likely to be encountered during shipment and storage of the ice maker 22 and the refrigerator/freezer 10. Thus, inadvertent activation of the thermally responsive fuse 60 is unlikely.

Figure 5:
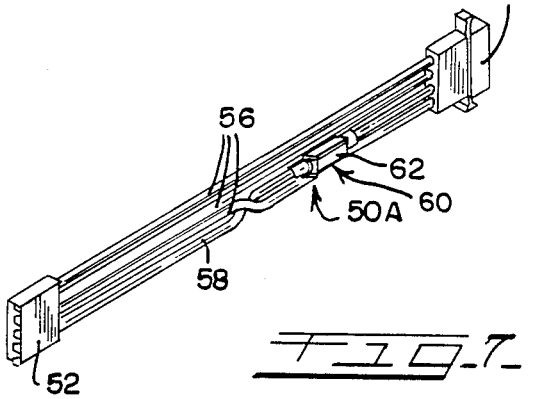
FIG. 5 is an enlarged, perspective view of another embodiment of a wiring harness of the ice maker.
Figure 7:
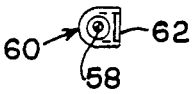
FIG. 7 is a transverse, cross-sectional view taken substantially along lines 7—7 of FIG. 6.
Figure 6:
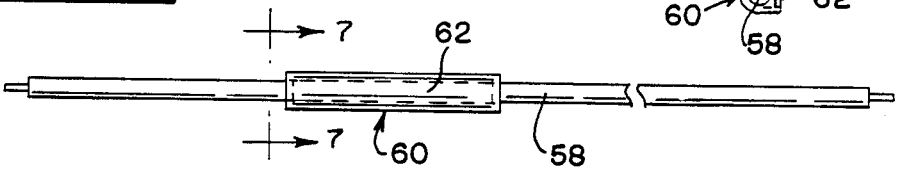
FIG. 6 is an enlarged, elevational view of an individual wire and fuse assembly of the harnesses of FIGS. 4 and 5 depicting a thermally sensitive contact surface of the fuse assembly.

Referring briefly to FIGS. 4 and 5, the harness 50 of FIG. 4 differs from a harness 50A of FIG. 5 only in that the connector 54 of the harness 50 is designed for use in a freezing chamber 12 having a porcelain lined wall 24 whereas the modified connector 54A is provided for the harness 50A designed for a plastic lined wall 24 of a freezing compartment.

Obviously, many modifications and variations of the present invention are possible in light of the above teachings. Thus, it is to be understood that, within the scope of the appended claims, the invention may be practiced otherwise than as specifically described hereinabove.

What is claimed and is desired to be secured by Letters Patent is:

1. An ice maker comprising a mold in which water is frozen to form one or more pieces of ice;

an electric heater for heating said old to free said ice for ejection from the mold;

an electrical lead for supplying said heater with electrical power for heating said mold;

a thermally actuated fuse in said electrical lead for interrupting said electrical power in response to a predetermined over temperature condition of said mold; and means for directly coupling said fuse to said said coupling means being releasably engageable with said mold.

2. An ice maker as recited in claim 1 wherein said mold comprises an elongate tray for containing said water to form a plurality of said pieces of ice spaced along the length of said tray between opposite ends thereof, said electric heater including an elongate heating element adjacent an underside of said tray extending between said opposite ends, said thermally activated fuse being positioned intermediate said ends adjacent to said mold.

3. An ice maker as recited in claim 2 wherein said coupling means includes a clip means releasably engageable with said tray for supporting said fuse.

4. An ice maker as recited in claim 3 wherein said clip means is secured to a lower portion of said tray and wherein said fuse is supported by said clip means at a level adjacent to said underside of said tray.

5. An ice maker as recited in claim 4 wherein said clip means includes a resilient pocket for releasably receiving and supporting said fuse.

6. An ice maker as recited in claim 5 wherein said resilient pocket of said clip means is configured to bias said heat sensitive face in the direction of said mold.

7. An icemaker as recited in claim 1 wherein said electrical lead is coupled at one end to a first connector releasably interconnectable with an electrical circuit coupled to said heater and at an opposite end to a second connector releasably interconnectable with means for supplying electrical power.

8. A refrigeration apparatus comprising a freezing chamber, an ice maker in said freezing chamber mounted adjacent a wall thereof, said ice maker including a mold in which water is frozen to form one or more pieces of ice, electric heater means in heat transfer relationship with said mold, means for supplying electrical power for operating said ice maker and for operating said heater means to temporarily elevate the temperature of said mold to free said pieces of ice from said mold prior to ejection therefrom a thermally actuated fuse for interrupting electrical power supplied to said heater means whenever the heat energy supplied to said mold reaches a predetermined level; and means for supporting said fuse, said supporting means coupling said heater directly to said fuse and being releasably engageable with said mold.

9. A refrigeration apparatus as recited in claim 8 wherein said thermally actuated fuse is positioned between said mold and said wall of said freezing chamber.

10. A refrigeration apparatus as recited in claim 8 wherein said support means comprises a resilient clip releasably engageable with said mold for supporting said fuse, said fuse having a heat sensitive surface disposed in the direction of said mold.

* * * * *

UNITED STATES PATENT AND TRADEMARK OFFICE

CERTIFICATE OF CORRECTION

PATENT NO. : 4,833,894

DATED : 30 May 1989

INVENTOR(S) : Paul B. Chestnut

It is certified that error appears in the above-identified patent and that said Letters Patent is hereby corrected as shown below:

Column 5, line 33, "old" should be --mold--;
Column 5, line 41, after "said", second occurrence, insert -- heater --.

Signed and Sealed this

Sixteenth Day of January, 1990

*Attest:*

JEFFREY M. SAMUELS

*Attesting Officer*

*Acting Commissioner of Patents and Trademarks*